United States Patent [19]

Johnson

[11] 4,429,479

[45] Feb. 7, 1984

[54] MAGAZINE LATCH RELEASE MECHANISM

[75] Inventor: David A. Johnson, 133 Eulalona Ct., Klamath Falls, Oreg. 97601

[73] Assignee: J.F.S., Inc., Salem, Oreg.

[21] Appl. No.: 371,959

[22] Filed: Apr. 26, 1982

[51] Int. Cl.[3] ..... F41C 27/00

[52] U.S. Cl. ..... 42/6

[58] Field of Search ..... 42/6, 18, 22

[56] References Cited

U.S. PATENT DOCUMENTS 1,069,339 8/1913 Layman ..... 42/18

2,305,033 12/1942 Roemer ..... 42/18

*Primary Examiner*—Charles T. Jordan

*Attorney, Agent, or Firm*—Chernoff, Vilhauer, McClung, Birdwell & Stenzel

[57] ABSTRACT

A magazine latch release mechanism for repeating rifles and the like having a magazine catch carried on an axially movable shaft extending laterally through the receiver of such a weapon is operable by a lever extending downward proximate the rear side of a removable magazine to permit release and removal of the magazine with one hand while the other hand continues to grip the weapon. A sleeve surrounds a portion of the laterally extending shaft within the receiver, part of the sleeve extending outwardly through a receiver wall. The sleeve is pinned to the shaft outside the receiver wall. An end of the latch release lever is pivotably connected to the sleeve within the receiver and the opposite end of the lever extends downwardly from the bottom of the receiver. A fulcrum portion of the lever is located adjacent an interior surface of the receiver, acting to move the sleeve and shaft in a direction opposite that in which the lower end portion of the lever is pressed, to disengage a catch from a removable magazine to release the magazine from the weapon. A cap fits around a portion of the sleeve and shaft exterior of the receiver to limit the extent of axial movement of the shaft.

7 Claims, 5 Drawing Figures

FIG. 1
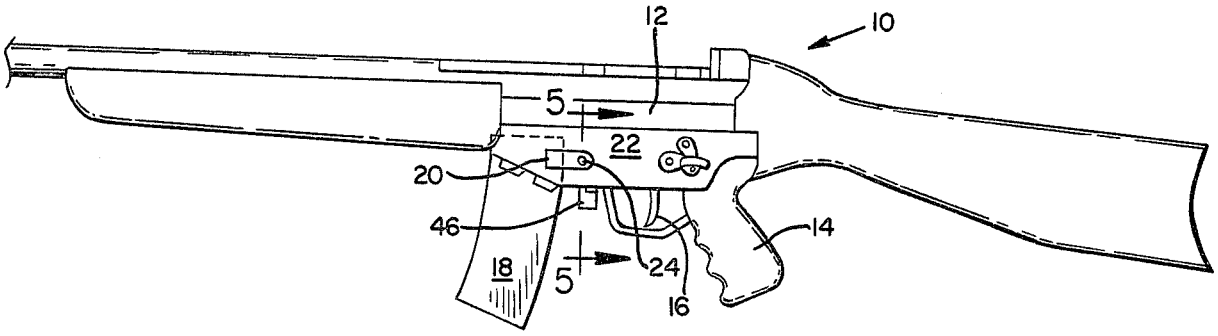
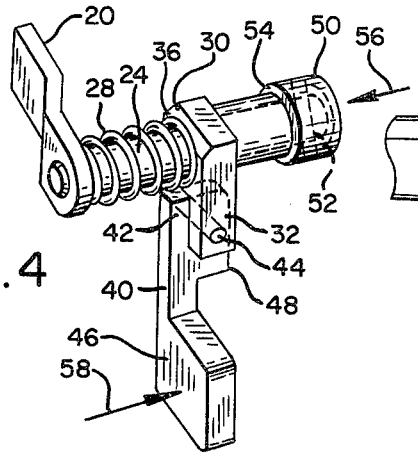
FIG. 4
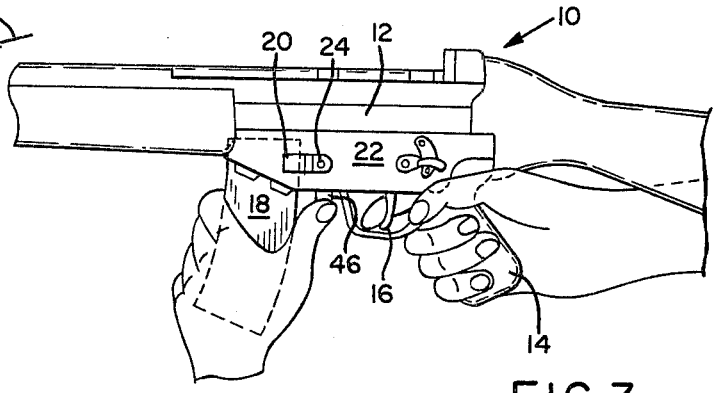
FIG. 3
FIG. 5
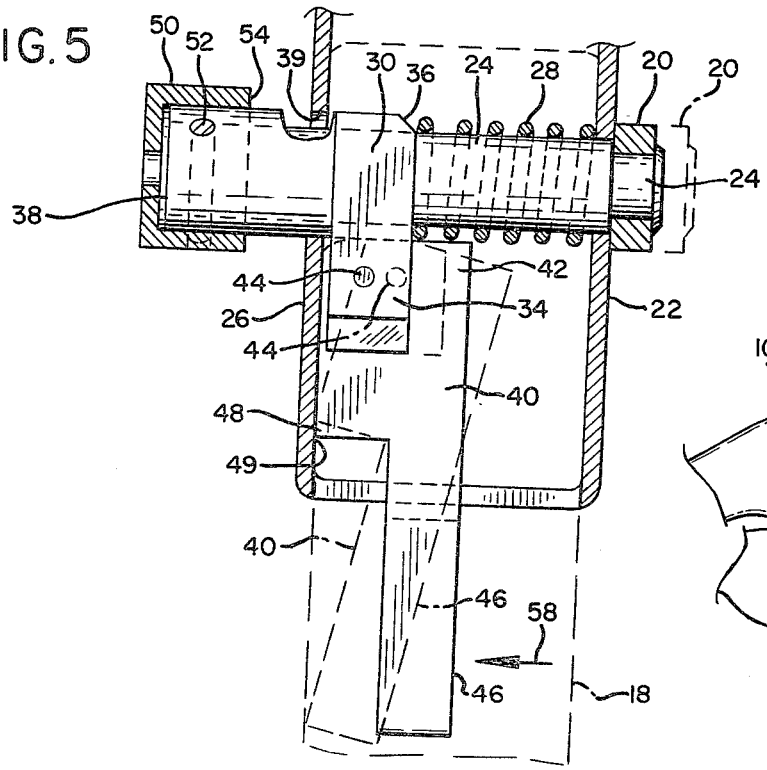
FIG. 2
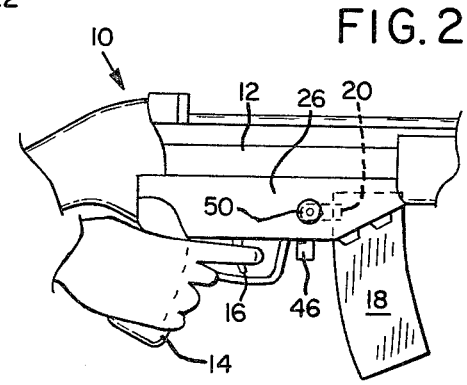

MAGAZINE LATCH RELEASE MECHANISM

BACKGROUND AND SUMMARY OF THE INVENTION

The present invention relates to improvements in mechanisms for releasing a removable magazine from a repeating firearm, and particularly to a latch-releasing mechanism which is operable by a hand which is used simultaneously to hold the magazine being removed from the firearm.

Certain firearms include removable magazines which may be loaded with cartridges to permit loading the weapon by removing an empty magazine and inserting a loaded one in its place. For example, Heckler & Koch Models 91 and 93 rifles use such removable magazines. Certain firearms, including the above-mentioned Heckler & Koch Models 91 and 93 rifles, retain such magazines by use of a catch attached to a shaft which extends transversely through the receiver of the firearm at a location forward of the trigger. The shaft is spring-loaded to a position holding the catch in its normal position of engagement with a magazine, the catch itself being located on the left side of the weapon. To release the magazine from the weapon, a protruding end portion of the shaft on the right-hand side must be pushed laterally leftward, moving the catch on the opposite end of the shaft laterally away from the left side of the receiver to release the magazine. A sleeve surrounds the right-hand end of the shaft, extending inwardly through the receiver wall to hold a spring against the interior surface of the opposite wall of the receiver, and includes a stop which limits the movement of the catch.

In the above-mentioned rifles the protruding end or sleeve on the transversely extending catch-carrying shaft is located too far from the normal position of the trigger (right) hand to permit the magazine to be released without moving the trigger hand from its normal position. Exchanging magazines in such weapons, then, becomes normally a two-hand operation, the right hand being used to release an empty magazine and thereafter being returned to its normal position on the grip of the weapon, and the left hand thereafter being used to insert a loaded magazine into the proper location in the receiver.

It is more desirable to have a latch mechanism which permits the magazine catch to be released easily with the hand used to remove the magazine from the weapon. Preferably such a latch mechanism would permit operation by the left hand, leaving the right hand free to hold the stock or grip of the weapon as the left hand removes and replaces the magazine. Left-handed operation of the latch mechanism, however, requires the manually movable portion of the latch mechanism to be located conveniently close to the magazine and to be accessible from the left side of the weapon.

The present invention provides an improved latch operating mechanism which makes one-handed removal and replacement of a magazine possible. According to the present invention a lever is pivotably connected to the axially movable transverse shaft of the magazine latch assembly in such a way that pushing an end of the lever laterally from the left side toward the right side of the weapon moves the transversely extending shaft from right to left of the weapon to disengage the catch, which is located on the left side of the weapon, from the magazine, by moving it the required distance outwardly away from the receiver. That is, by pushing the lever toward the right of the weapon, the shaft is moved toward the left side. The end of the lever on which one can push is located conveniently near the rear of the magazine, on the left side of the weapon, where the left thumb can be used to push the lever toward the right side of the weapon while the left hand is held below the receiver, gripping a downwardly extending portion of the magazine, or in a position to receive the magazine as it drops downward from its normal position within the receiver of the weapon.

According to the present invention a sleeve is placed around the transversely extending shaft and extends through the receiver wall to the outside of the receiver, where a pin secures the sleeve to the shaft. A helical spring surrounds the transverse latch shaft between the interior of the left wall of the receiver and the left end of the sleeve, normally urging the shaft toward the right side of the weapon. A cap extends around the sleeve and the end of the shaft, exterior of the receiver, to limit leftward axial movement of the shaft to the desired amount. Between the receiver walls, one end of a latch mechanism operating lever is pivotably connected to the sleeve. The latch mechanism operating lever according to the present invention extends downwardly from the pivot connection, which is located near the right wall of the receiver, toward a position below the receiver. A fulcrum portion of the lever also extends to a location adjacent the interior surface of the right wall of the receiver, spaced downwardly from the pivot connection of the lever to the sleeve. Pushing the lower end of the lever toward the right forces the fulcrum portion of the lever against the interior surface of the right receiver wall, and by reaction forces the shaft laterally toward the left side of the receiver.

It is therefore a principal objective of the present invention to provide an improved magazine latch operating mechanism for firearms having removable magazines.

It is another improtant objective of the present invention to provide a magazine latch operating mechanism permitting convenient one-handed release and removal of a magazine from a repeating firearm.

It is an important feature of the present invention that a magazine latch mechanism operating lever extends to a location conveniently near a removable magazine to permit the lever to be operated by the thumb of a hand while the magazine is being held by that hand.

It is another important feature of the present invention that it provides a magazine release mechanism which can be installed easily as a modification of a preexisting inconveniently operable latch mechanism.

It is a principal advantage of the present invention that it is operable much more conveniently than the previously existing magazine latch mechanisms of certain firearms to which the present invention's mechanism is applicable.

The foregoing objectives, features and advantages of the present invention will be more readily understood upon consideration of the following detailed description of the invention taken in conjunction with the accompanying drawings.

BRIEF DESCRIPTION OF THE DRAWINGS

FIG. 1 is a left side elevational view of an automatic rifle including a latch release mechanism embodying the present invention.

FIG. 2 is a right side elevational view of a portion of the rifle shown in FIG. 1.

FIG. 3 is a left side elevational view of a portion of the rifle shown in FIG. 1, showing the method of operating the latch release mechanism of the present invention.

FIG. 4 is a pictorial view of a magazine latch mechanism embodying the present invention, at an enlarged scale.

FIG. 5 is a sectional view of a detail of the rifle shown in FIG. 1, taken along line 5—5 at an enlarged scale.

DETAILED DESCRIPTION OF THE INVENTION

Referring now to the drawings, the present invention provides a magazine latch release mechanism which will be understood with reference to an exemplary repeating firearm such as the rifle 10 having a receiver 12, a pistol grip 14, and a trigger 16. The upper end of a magazine 18 may be inserted upwardly into a cavity defined in the bottom of the receiver 12, and is ordinarily held in place in the weapon by a catch 20 which extends inwardly through an opening (not shown) in the left side wall 22 of the receiver 12. The catch 20 engages a protrusion (not shown) on the left side of the magazine 18 to retain the magazine properly attached to the receiver 12.

The catch 20 is carried on a shaft 24, to which it is fixedly attached, for example by riveting. The shaft 24 extends transversely of the receiver 12, through the left side wall 22 and the right side wall 26, at a location rearward of the magazine. Surrounding the shaft 24, within the receiver 12 and abutting against the interior surface of the left side wall 22, is a helical compressible spring 28 whose opposite end abuts against the end of a sleeve 30 which surrounds a portion of the shaft 24, extending through the right side wall 26 to the end of the shaft 24.

Located between the receiver walls 22 and 26, a pair of parallel ears 32 and 34, shown respectively in FIGS. 4 and 5, are fixedly interconnected with the sleeve 30 and extend downwardly beneath the shaft 24 as a fork. Above the shaft 24, part of the sleeve 30 opposite the parallel ears 32 and 34 is tapered to provide a beveled surface 36, which permits the sleeve to be installed by allowing it to turn within the receiver 12 while the outer end 38 of the sleeve (shown partially broken away in FIG. 5) is pushed outwardly through an aperture 39 provided in the right receiver wall 26.

A latch release lever 40 has an upper end 42 located between the ears 32 and 34. The upper end 42 is pivotably attached to the sleeve 30 by a pivot pin 44 oriented longitudinally of the rifle 10, thus perpendicular to the shaft 24. The pivot pin 44 extends through the ears 32 and 34, as well as the upper end 42. The lever 40 depends downwardly beneath the shaft 24 and includes an ear 46 which extends rearwardly from the lower portion of the main stem of the lever 40 as an enlarged area upon which the user may conveniently press with his thumb to operate the latch release mechanism of the present invention. The lever 40 includes a fulcrum or cam portion 48 located adjacent the interior surface 49 of the right side wall 26 and below the pivot pin 44.

Exterior of the receiver 12, a cap 50 surrounds the outer end 38 of the sleeve 30 and the shaft 24, being retained by a pin 52 which extends through the cap 50, the sleeve 30, and the shaft 24. An edge 54 of the cap 50 faces toward the right side wall 26 of the receiver 12 and is spaced apart from the wall 26 ordinarily, but limits motion of the shaft 24 by contacting the exterior surface of right side wall 26 to prevent the shaft 24 from moving so far that the catch 20 might move out of alignment with the opening in the left side wall 22, through which it must extend to secure a removable magazine 18.

While the magazine latch release mechanism of the present invention may be operated in the same fashion as that which it replaces, by pushing against the cap 50 in the direction of the arrow 56 (FIG. 4), it is preferably used by pressing the ear 46 in the direction of the arrow 58 against the ear 46, as shown in FIG. 3, with the thumb of the left hand, while the removable magazine 18 is gripped by the fingers and palm of the left hand. This permits the removable magazine 18 to be removed from the receiver 12 with the left hand while the right hand remains on the pistol grip 14. As the ear 46 of the lever 40 moves toward the right side of the rifle 10 the fulcrum 48 rides against the interior surface 49. The lever 40 pivots about the fulcrum 48, moving the sleeve 30, shaft 24, and catch 20 toward the left side of the rifle 10 and compressing the spring 28. As the catch 20 moves outward, toward the left, it disengages the magazine 18. The edge surface 54 of the cap 50 prevents the shaft 24 from moving too far.

The sleeve 30, lever 40, and cap 50 may each be manufactured by machining from solid metal. Assembly of the latch mechanism of the invention may be carried out by first connecting the lever 40 to the sleeve 30 by insertion of the pin 44 through the ears 32 and 34 and the upper portion 42 of the lever 40. Thereafter the sleeve and lever assembly may be placed within the receiver and the outer end 38 of the sleeve moved outwardly through the aperture 39 in the right wall 26 of the receiver. Next the shaft 24 may be inserted from the exterior of the left side wall 22 of the receiver, passing it through the helical spring 28 and the sleeve 30. Finally, the cap 50 may be placed over the outer end 38 and the shaft 24 in proper orientation, permitting the pin 52 to be inserted.

The magazine latch release mechanism of the present invention may be incorporated in its entirety as a part of a newly manufactured weapon in which the magazine may be removed conveniently with the use of one hand. Alternatively, a kit containing the lever 40, sleeve 30, and cap 50 may be installed in, for example, a Heckler and Koch model 91 or 93 rifle by removing the original latch mechanism and installing the sleeve 30 and lever 40 as previously described, reinstalling the original shaft and spring, adding the cap 50, and the pin 52. This modification of the original rifle permits convenient removal of the magazine 18 thereafter by using only the left hand.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is Claimed is:

1. In a repeating firearm having a receiver defining a location for a removable magazine and including laterally spaced-apart generally upright walls extending rearwardly of said location, and also having a magazine latch mechanism including a laterally extending axially slidable shaft mounted in said receiver and carrying a catch attached thereto, a magazine latch release mechanism, comprising:

(a) biasing means for urging said shaft axially toward a first wall of said receiver;

(b) sleeve means surrounding said shaft and extending through said first wall; and (c) lever means for moving said shaft axially away from said first wall, said lever means having an upper end pivotably attached to said sleeve means, a lower end extending downwardly beneath said receiver, and fulcrum means located intermediate said upper and lower ends for acting against an interior surface of said first wall of said receiver for moving said shaft axially away from said first wall in response to movement of said lower end toward said first wall.

2. The latch mechanism of claim 1 wherein said sleeve means includes a fork extending radially away from said sleeve between said walls of said receiver, an upper end of said lever means extending within said frok and being connected therewith by a pivot pin extending through said fork and said upper end of said lever means.

3. The latch mechanism of claim 1, including motion-limiting means for preventing said shaft from moving axially away from said first wall beyond a predetermined position.

4. The magazine latch mechanism of claim 3, said motion-limiting means including a cap surrounding respective portions of said sleeve and said shaft exterior of said receiver, adjacent to said first wall thereof.

5. The latch mechanism of claim 1 wherein said lever means is located rearwardly adjacent said location for a removable magazine, said lower end including a rearwardly extending ear portion.

6. A modification kit for modifying a magazine latch assembly of a firearm having laterally spaced apart first and second receiver side walls including an axially reciprocally movable shaft extending transversely through at least one of said receiver walls of said firearm, a magazine catch fixedly attached to a first end of the shaft, a spring for urging the shaft in a first direction and a second end of the shaft being manually engageable to move the shaft axially to disengage the catch from a removable magazine, the kit comprising:

(a) sleeve means for surrounding a portion of said shaft adjacent said second end, said sleeve means including pivot means for attaching a lever to said sleeve means between the walls of said receiver; and (b) a lever having an upper portion pivotably attached to said pivot means, a lower portion spaced apart therefrom, and fulcrum means located intermediate said upper and lower portions for acting against the interior surface of said first side wall of said receiver to move said sleeve means toward said second receiver wall in response to movement of said lower portion toward said first receiver wall.

7. The kit of claim 6, including cap means for fitting around said end of said shaft and around a portion of said sleeve means exterior of said receiver wall for limiting the extent of axial movement of said shaft.

* * * * *